US011430387B2

(12) United States Patent
Furukawa et al.

(10) Patent No.: US 11,430,387 B2
(45) Date of Patent: Aug. 30, 2022

(54) DISPLAY DEVICE AND DRIVING METHOD THEREFOR

(71) Applicant: SHARP KABUSHIKI KAISHA, Sakai (JP)

(72) Inventors: Hiroyuki Furukawa, Sakai (JP); Masafumi Ueno, Sakai (JP); Chie Toridono, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/438,374

(22) PCT Filed: Mar. 29, 2019

(86) PCT No.: PCT/JP2019/014023
§ 371 (c)(1),
(2) Date: Sep. 10, 2021

(87) PCT Pub. No.: WO2020/202260
PCT Pub. Date: Oct. 8, 2020

(65) Prior Publication Data

US 2022/0157240 A1 May 19, 2022

(51) Int. Cl.
*G09G 3/3233* (2016.01)
*G09G 3/20* (2006.01)

(52) U.S. Cl.
CPC ..... *G09G 3/3233* (2013.01); *G09G 3/2096* (2013.01); *G09G 2320/0285* (2013.01); *G09G 2320/0295* (2013.01); *G09G 2320/043* (2013.01); *G09G 2320/045* (2013.01); *G09G 2360/16* (2013.01)

(58) Field of Classification Search
None
See application file for complete search history.

(56) References Cited

U.S. PATENT DOCUMENTS

2010/0134475 A1* 6/2010 Ogura ..... G09G 3/3291 345/213
2015/0124004 A1* 5/2015 Hayashi ..... G09G 3/3233 345/76

(Continued)

FOREIGN PATENT DOCUMENTS

JP 2006-091709 A 4/2006
KR 10-2018-0021947 A 3/2018

(Continued)

OTHER PUBLICATIONS

KR20180021947 English translation printed from Search, pp. 1-17 (Year: 2018).*

*Primary Examiner* — Dorothy Harris
(74) *Attorney, Agent, or Firm* — ScienBiziP, P.C.

(57) ABSTRACT

In a display device that performs external compensation, pixel circuits are classified into specific and general pixel circuits. When display is restarted, a current measurement circuit, along with a drive circuit, measures a current flowing through a drive transistor in the specific pixel circuit as a first current. A correction circuit obtains a recovery ratio for a characteristic of the drive transistor on the basis of an amount of the first current and corrects a video signal for each of the specific and general pixel circuits using the recovery ratio. Thus, when display is restarted, a suitably compensated image is displayed.

13 Claims, 8 Drawing Sheets

(56) References Cited

U.S. PATENT DOCUMENTS

| | | | | |
|---|---|---|---|---|
| 2015/0379940 | A1* | 12/2015 | Kishi | G09G 3/3291 345/77 |
| 2016/0111044 | A1 | 4/2016 | Kishi et al. | |
| 2017/0186369 | A1* | 6/2017 | Hayashi | G09G 3/3233 |

FOREIGN PATENT DOCUMENTS

| | | | | |
|---|---|---|---|---|
| KR | 20180021947 | A | * | 3/2018 |
| WO | 2014/141958 | A1 | | 9/2014 |
| WO | 2014/208459 | A1 | | 12/2014 |

* cited by examiner

DISPLAY DEVICE AND DRIVING METHOD THEREFOR

TECHNICAL FIELD

The disclosure relates to display devices, particularly to a display device including current-driven display elements and a method for driving the same.

BACKGROUND ART

Organic electroluminescent (referred to below as EL) display devices are thin and lightweight display devices that offer high image quality and are used in various electronic devices. The organic EL display device has a display portion (organic EL panel) including a plurality of pixel circuits, each including a drive transistor and an organic EL element. In each pixel circuit, the drive transistor and the organic EL element are connected in series and have approximately the same amount of drive current flowing therethrough. The amount of drive current changes depending on a gate-source voltage of the drive transistor, and the organic EL element emits light with a luminance corresponding to the amount of drive current.

Characteristics of the drive transistor gradually deteriorate during display. The following will focus on threshold voltage, which is one of the characteristics of the drive transistor. The threshold voltage of the drive transistor gradually changes (increases or decreases) during display such that the drive current decreases. Accordingly, as the duration of display increases, the drive current that is flowing through the organic EL element decreases, resulting in a reduced luminance of the display portion.

Some organic EL display devices deal with luminance reduction by performing the process of correcting a video signal for use in driving the display portion, on the basis of a current flowing through the drive transistor, as measured from outside the display portion upon application of a measurement voltage to a gate terminal of the drive transistor (this process will be referred to below as external compensation). Organic EL display devices that perform external compensation are described in, for example, Patent Documents 1 to 3. By performing external compensation, it is possible to compensate for deterioration of the characteristics of the drive transistor and thereby prevent luminance reduction.

CITATION LIST

Patent Documents

Patent Document 1: Japanese Laid-Open Patent Publication No. 2006-91709
Patent Document 2: WO 2014/141958
Patent Document 3: WO 2014/208459

SUMMARY

Technical Problem

The characteristics of the drive transistor basically deteriorate over the duration of display. However, the characteristics of the drive transistor recover to some extent while display is stopped. Therefore, when the display is restarted after the stop, if video signals are corrected on the basis of currents measured before the stop, the video signals are overcorrected, with the result that an overcompensated image is displayed.

In a specific and known external compensation method (referred to below as real-time monitoring), currents flowing through drive transistors in one to several rows of pixel circuits are measured during a current measurement period being set within one frame period. However, in the case where real-time monitoring is performed, it takes, for example, a minute or more to measure the currents flowing through the drive transistors in all of the pixel circuits. Therefore, also in the case of organic EL display devices that perform real-time monitoring, video signals are overcorrected for some time after display is restarted, with the result that an overcompensated image is displayed.

Therefore, a problem to be addressed is to provide a display device displaying a suitably compensated image when display is restarted.

Means for Solving the Problems

The above-described problem can be solved by a display device, for example, including: a display portion including a plurality of pixel circuits, each including a drive transistor and a display element connected in series; a drive circuit configured to drive the display portion; a current measurement circuit configured to measure a current flowing through the drive transistor, from outside the display portion; and a correction circuit configured to obtain a characteristic of the drive transistor on the basis of an amount of the current and correct a video signal for use in driving the display portion, on the basis of the characteristic, wherein, the pixel circuits are classified into specific and general pixel circuits, when display is restarted, the current measurement circuit, along with the drive circuit, measures the current for the specific pixel circuit as a first current, and the correction circuit includes a recovery ratio calculation portion configured to obtain a recovery ratio for the characteristic on the basis of an amount of the first current, and corrects the video signal for each of the specific and general pixel circuits using the recovery ratio.

The above-described problem can also be solved by a method for driving a display device having a display portion including a plurality of pixel circuits, each including a drive transistor and a display element connected in series, the method including: a driving step of driving the display portion; a measuring step of measuring a current flowing through the drive transistor, from outside the display portion; and a correcting step of obtaining a characteristic of the drive transistor on the basis of an amount of the current and correcting a video signal for use in driving the display portion, on the basis of the characteristic, wherein, the pixel circuits are classified into specific and general pixel circuits, when display is restarted, the measuring step is performed along with the driving step to measure the current for the specific pixel circuit as a first current, and the correcting step includes a recovery ratio calculating step of obtaining a recovery ratio for the characteristic on the basis of an amount of the first current, and in the correcting step the video signal is corrected for each of the specific and general pixel circuits using the recovery ratio.

Effect of the Disclosure

In the case of the display device described above or the method for driving the same, when display is restarted, the recovery ratio for the characteristic of the drive transistor in the specific pixel circuit is obtained on the basis of the amount of current flowing through the drive transistor, and the video signal is corrected using the recovery ratio until a normal mode operation becomes possible. Accordingly, when display is restarted, it is possible to display a suitably compensated image considering that the characteristic of the drive transistor recovers while display is stopped. Moreover, when display restarted, the current flowing through the drive transistor in the specific pixel circuit is measured so that a process for restarting the display can be performed in a short period of time.

BRIEF DESCRIPTION OF THE DRAWINGS

FIG. 7 is a diagram illustrating the operation of the correction circuit shown in FIG. 4 at the time of power on.

DESCRIPTION OF EMBODIMENTS

First Embodiment

Figure 1:
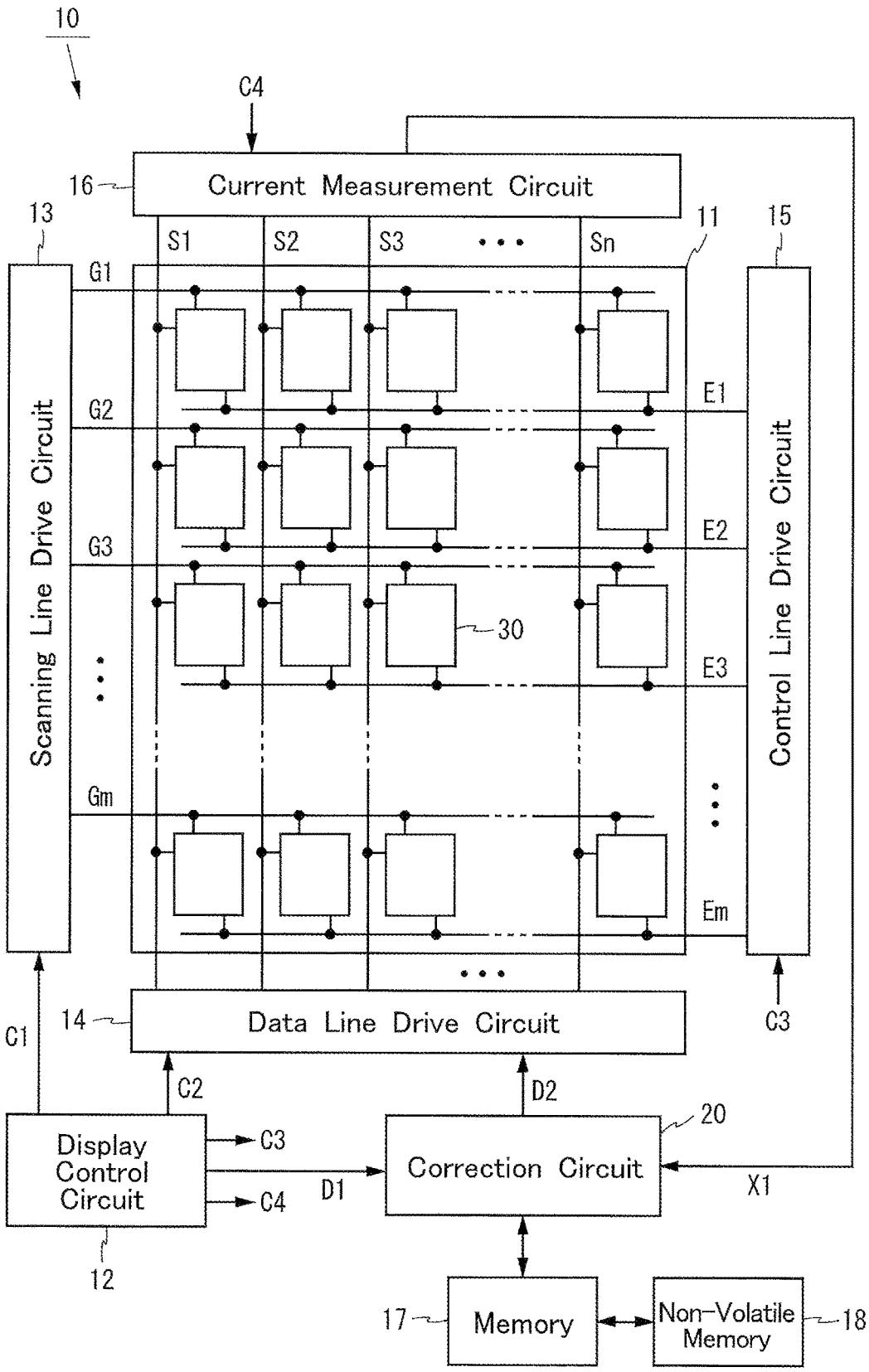
FIG. 1 is a block diagram illustrating the configuration of an organic EL display device according to a first embodiment.

FIG. 1 is a block diagram illustrating the configuration of an organic EL display device according to a first embodiment. The organic EL display device 10 shown in FIG. 1 includes a display portion 11, a display control circuit 12, a scanning line drive circuit 13, a data line drive circuit 14, a control line drive circuit 15, a current measurement circuit 16, memory 17, non-volatile memory 18, and a correction circuit 20. In the following, m and n are integers of 2 or more, i is an integer from 1 to m, and j is an integer from 1 to n.

The display portion 11 includes m scanning lines G1 to Gm, n data lines S1 to Sn, m control lines E1 to Em, and (m×n) pixel circuits 30. The scanning lines G1 to Gm are arranged parallel to each other. The data lines S1 to Sn are arranged parallel to each other and perpendicular to the scanning lines G1 to Gm. The control lines E1 to Em are arranged parallel to the scanning lines G1 to Gm. The scanning lines G1 to Gm and the data lines S1 to Sn intersect with each other at (m×n) points. The (m×n) pixel circuits 30 are arranged corresponding to the intersections of the scanning lines G1 to Gm and the data lines S1 to Sn. The display portion 11 is formed on an unillustrated organic EL panel. All or some of the following may be integrally formed with the display portion 11 on the organic EL panel: the scanning line drive circuit 13; the data line drive circuit 14; the control line drive circuit 15; and the current measurement circuit 16.

Figure 2:
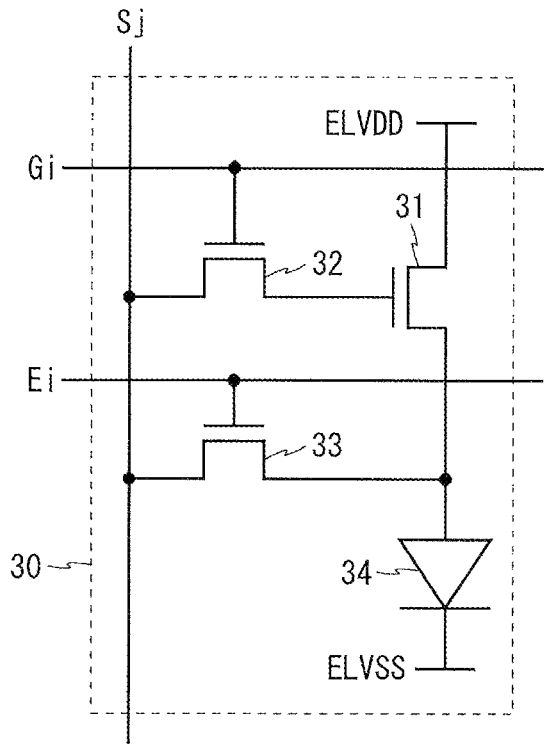
FIG. 2 is a circuit diagram of a pixel circuit in the organic EL display device shown in FIG. 1.

FIG. 2 is a circuit diagram of the pixel circuit 30. FIG. 2 shows the i'th row, j'th column pixel circuit 30. The pixel circuit 30 includes three TFTs (thin-film transistors) 31 to 33 and an organic EL element 34. The TFTs 31 to 33 are N-channel transistors. The TFT 31 functions as a drive transistor, and the organic EL element 34 functions as a current-driven display element.

The TFT 31 has a drain terminal to which a high-level power supply voltage ELVDD is applied. The TFT 31 is connected at a source terminal to an anode terminal of the organic EL element 34. The organic EL element 34 has a cathode terminal to which a low-level power supply voltage ELVSS is applied. The TFTs 32 and 33 are connected at one conductive terminal (in FIG. 2, the respective left conductive terminals) to the data line Sj. The TFT 32 is connected at the other conductive terminal to a gate terminal of the TFT 31. The TFT 33 is connected at the other conductive terminal to the source terminal of the TFT 31 and the anode terminal of the organic EL element 34. The TFT 32 is connected at a gate terminal to the scanning line Gi, and the TFT 33 is connected at a gate terminal to the control line Ei.

For the organic EL display device 10, one frame period includes m horizontal periods and one current measurement period. During each horizontal period, voltages corresponding to video signals for one row of pixel circuits 30 are written to the respective pixel circuits 30 in the row. During the current measurement period, one row of pixel circuits 30 are measured for the amount of current flowing through the drive transistor (TFT 31) upon application of a measurement voltage to the gate terminal of the drive transistor. In the following, the i'th horizontal period will be denoted by Hi, and the current measurement period for the i'th row pixel circuits 30 will be denoted by Mi.

The display control circuit 12 outputs control signals C1, C2, C3, and C4 to the scanning line drive circuit 13, the data line drive circuit 14, the control line drive circuit 15, and the current measurement circuit 16, respectively. The scanning line drive circuit 13 drives the scanning lines G1 to Gm in accordance with the control signal C1. The data line drive circuit 14 drives the data lines S1 to Sn in accordance with the control signal C2 and video signals D2 outputted by the correction circuit 20. The control line drive circuit 15 drives the control lines E1 to Em in accordance with the control signal C3. The current measurement circuit 16 measures currents flowing through the data lines S1 to Sn in accordance with the control signal C4, and outputs measurement result signals X1 indicating the results of the current measurements. The scanning line drive circuit 13, the data line drive circuit 14, and the control line drive circuit 15 collectively function as a circuit for driving the display portion 11.

The scanning line drive circuit 13 applies a high-level voltage to the i'th scanning line Gi and a low-level voltage to the other scanning lines during the horizontal period Hi. The data line drive circuit 14 applies n voltages to the respective data lines S1 to Sn in accordance with video signals D2 corresponding to the i'th row pixel circuits 30 during the horizontal period Hi. The control line drive circuit 15 applies a low-level voltage to the control lines E1 to Em during the horizontal period Hi.

The i'th row pixel circuits 30 have the TFTs 32 on and the TFTs 33 off during the horizontal period Hi. Accordingly, the voltages that correspond to the video signals D2 are applied to the gate terminals of the TFTs 31. The scanning line drive circuit 13 applies a low-level voltage to the scanning line Gi at the end of the horizontal period Hi. At this time, the TFTs 32 are turned off, so that gate-source voltages of the TFTs 31 do not change thereafter. After the end of the horizontal period Hi, the TFTs 31 and the organic EL elements 34 allow drive currents to flow therethrough in amounts corresponding to the gate-source voltages of the TFTs 31, and the organic EL elements 34 emit light with luminances corresponding to the amounts of the drive currents.

In this manner, during the horizontal period Hi, the i'th row pixel circuits 30 are collectively selected, and the n voltages that correspond to the video signals D2 are applied to the respective gate terminals of the TFTs 31 in the i'th row pixel circuits 30. After the end of the horizontal period Hi, the organic EL elements 34 in the i'th row pixel circuits 30 emit light with luminances corresponding to the video signals D2.

The current measurement period Mi includes a writing period and a measurement period. The scanning line drive circuit 13 applies a high-level voltage to the i'th scanning line Gi and a low-level voltage to the other scanning lines during the writing period within the current measurement Period Mi. The data line drive circuit 14 applies a measurement voltage to the data lines S1 to Sn during the writing period within the current measurement period Mi. The control line drive circuit 15 applies a low-level voltage to the control lines E1 to Em during the writing period within the current measurement period Mi.

The i'th row pixel circuits 30 have the TFTs 32 on and the TFTs 33 off during the writing period within the current measurement period Mi. Accordingly, the measurement voltage is applied to the gate terminals of the TFTs 31. In this manner, during the writing period within the current measurement period Mi, the i'th row pixel circuits 30 are collectively selected, and the measurement voltage is applied to the gate terminals of the TFTs 31 in the i'th row pixel circuits 30.

The scanning line drive circuit 13 applies a low-level voltage to the scanning lines G1 to Gm during the measurement period within the current measurement period Mi. The data line drive circuit 14 applies no voltage to the data lines S1 to Sn during the measurement period within the current measurement period Mi. The control line drive circuit 15 applies a high-level voltage to the i'th control line Ei and a low-level voltage to the other control lines during the measurement period within the current measurement period Mi.

The i'th row pixel circuits 30 have the TFTs 32 off and the TFTs 33 on during the measurement period within the current measurement period Mi. Accordingly, the i'th row pixel circuits 30 output the currents that are flowing through the drive transistors (TFTs 31), to the data lines S1 to Sn. The current measurement circuit 16 measures these n currents being outputted to the data lines S1 to Sn during the measurement period within the current measurement period Mi.

The correction circuit 20 receives video signals D1 outputted by the display control circuit 12 and measurement result signals X1 outputted by the current measurement circuit 16. The correction circuit 20 obtains characteristics of the drive transistors on the basis of amounts of current indicated by the measurement result signals X1, corrects the video signals D1 for use in driving the display portion 11, on the basis of the obtained characteristics, and outputs corrected video signals D2 to the data line drive circuit 14. At this time, the correction circuit 20 uses the memory 17 as working memory.

In this manner, in the organic EL display device 10, the currents that are flowing through the drive transistors (TFTs 31) upon application of the measurement voltages to the gate terminals of the drive transistors are measured from outside the display portion 11, and the process of correcting the video signals D1 for use in driving the display portion 11 (external compensation) is performed on the basis of the measured currents.

Figure 3:
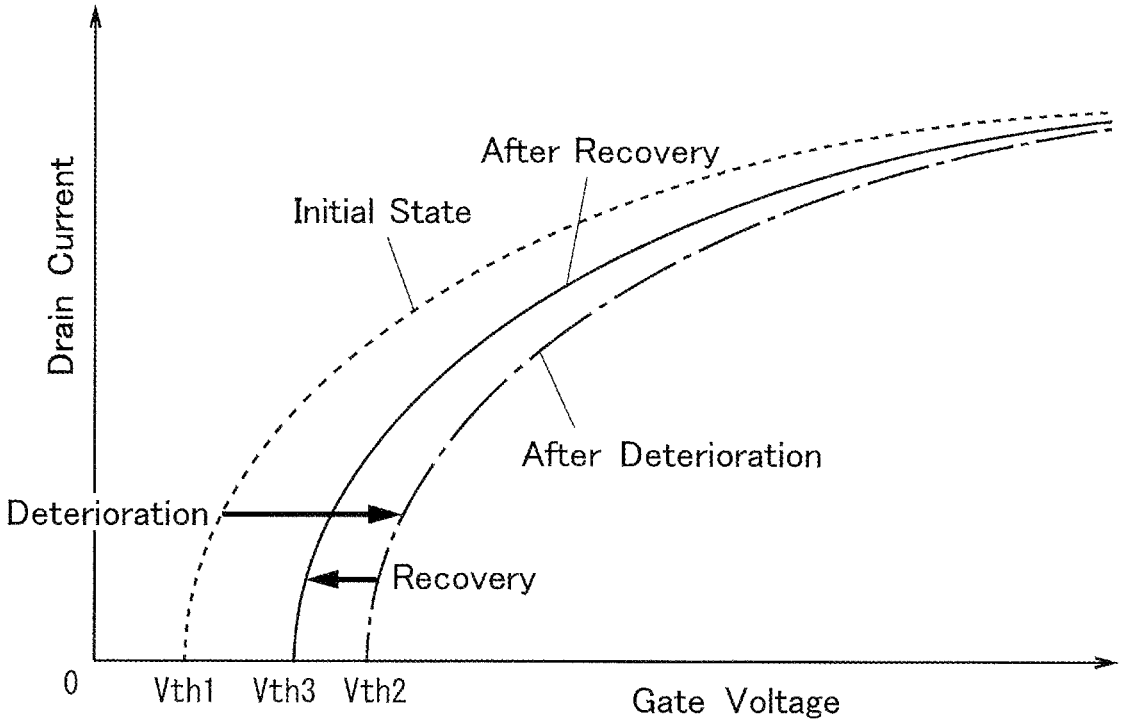
FIG. 3 is an I-V characteristic graph for a drive transistor in the organic EL display device shown in FIG. 1.

The characteristic of the drive transistor will be described in terms of deterioration from an initial state and recovery to the initial state, along with correction of the video signal D1 to allow a display luminance characteristic to return to an initial state. The following descriptions will focus on threshold voltage, which is one of the characteristics of the drive transistor. FIG. 3 is an I-V characteristic graph for the drive transistor. FIG. 3 shows initial, deteriorated, and recovered states of the characteristic for one drive transistor. The drive transistor initially has a threshold voltage Vth1, for which the drive transistor is characterized by the dotted curve. The threshold voltage of the drive transistor is increased from Vth1 to Vth2 due to deterioration during display. When the display is stopped, the threshold voltage of the drive transistor is Vth2, for which the drive transistor is characterized by the dash-dotted curve. While the display is stopped, the threshold voltage of the drive transistor is decreased from Vth2 to Vth3 due recovery. When the display is restated, the threshold voltage of the drive transistor is Vth3, for which the drive transistor is characterized by the solid curve.

The amount cf change in the threshold voltage due to deterioration (Vth2−Vth1) will be referred to as the deterioration amount and denoted by ΔVtha. The amount of change in the threshold voltage in the opposite direction due to recovery (Vth2−Vth3) will be referred to as the recovered amount and denoted by ΔVthb. The ratio of the recovered amount to the deterioration amount (ΔVthb/ΔVtha) will be referred to as the recovery ratio and denoted by α. The recovery ratio α takes a value from 0 to 1.

In the case of the organic EL display device 10, when display is restarted, predetermined pixel circuits are measured for the amount of current earlier than the rest of the (m×n) pixel circuits 30. Hereinafter, such predetermined pixel circuits will be referred to as specific pixel circuits, and the other pixel circuits will be referred to as general pixel circuits. The pixel circuits 30 are classified into specific and general pixel circuits. In the case of the organic EL display device 10, both when display is stopped and when display is restarted, the specific pixel circuit is measured for the amount of current flowing through the drive transistor in a manner similar to that used during the current measurement period.

Preferably, the number of specific pixel circuits is sufficiently less than the number of general pixel circuits. For example, all or some pixel circuits 30 in one to several rows may be specific pixel circuits. In particular, pixel circuits 30 having a high luminance and therefore anticipated to be susceptible to deterioration are preferably selected as specific pixel circuits. For example, all or some pixel circuits 30 in one to several rows at or around the center of the display screen may be selected as specific pixel circuits. Alternatively, all or some pixel circuits 30 in a plurality of rows distanced from each other within the display screen may be selected as specific pixel circuits.

Figure 4:
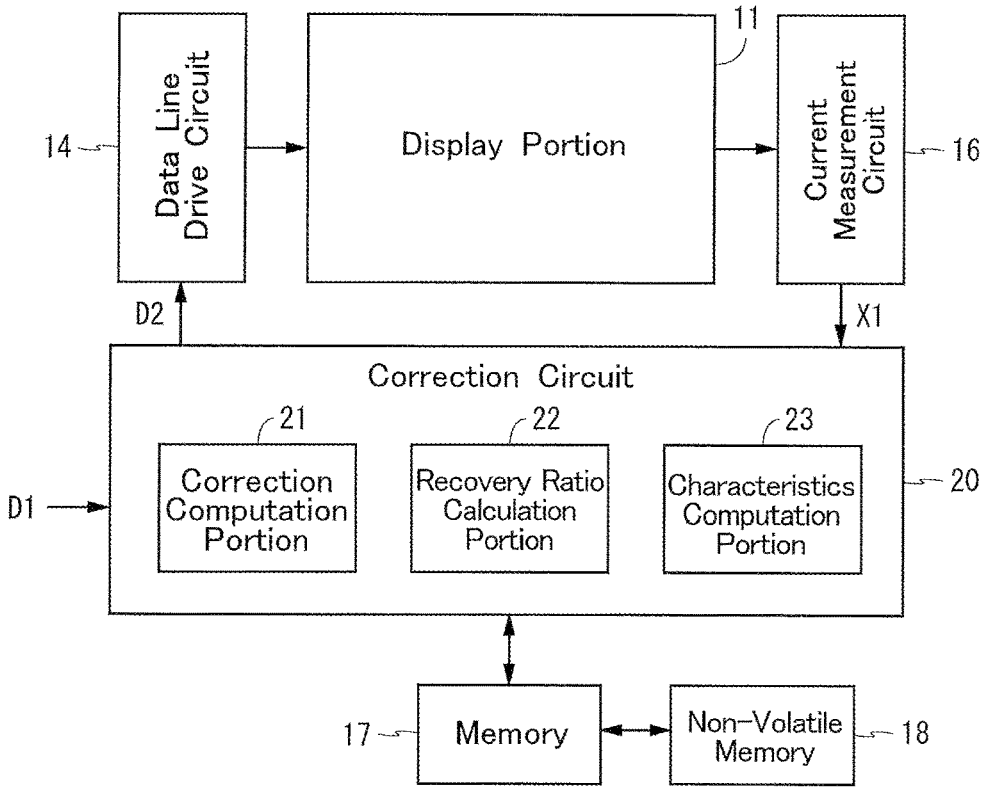
FIG. 4 is a block diagram illustrating the details of a correction circuit in the organic EL display device shown in FIG. 1.
Figure 5:
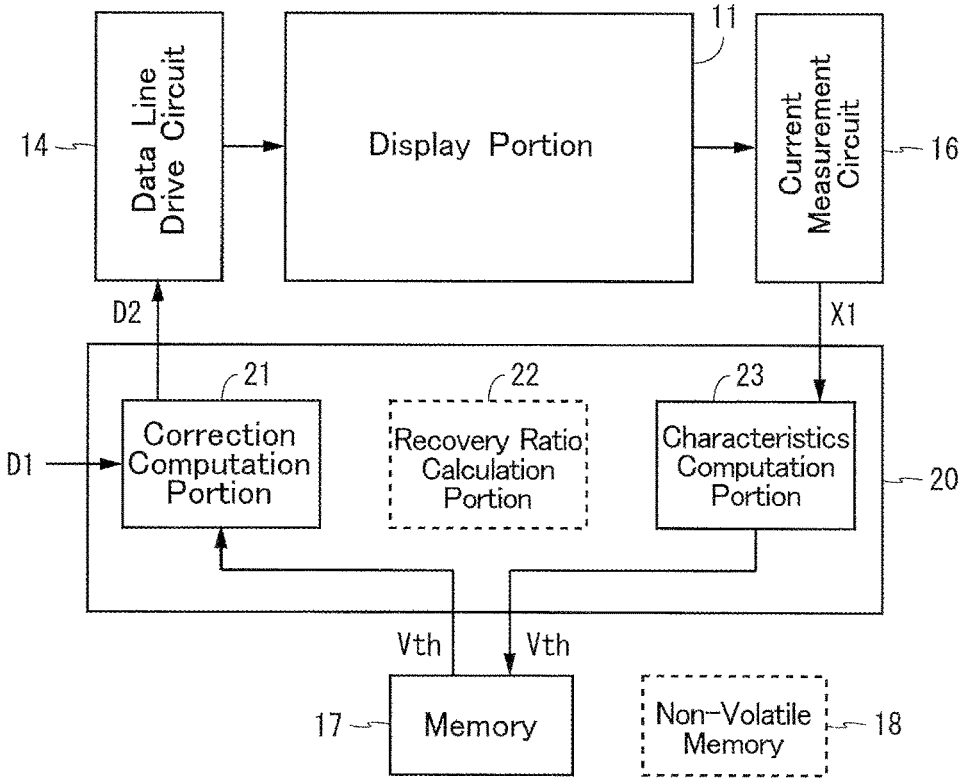
FIG. 5 is a diagram illustrating the operation of the correction circuit shown in FIG. 4 during a normal mode.
Figure 6:
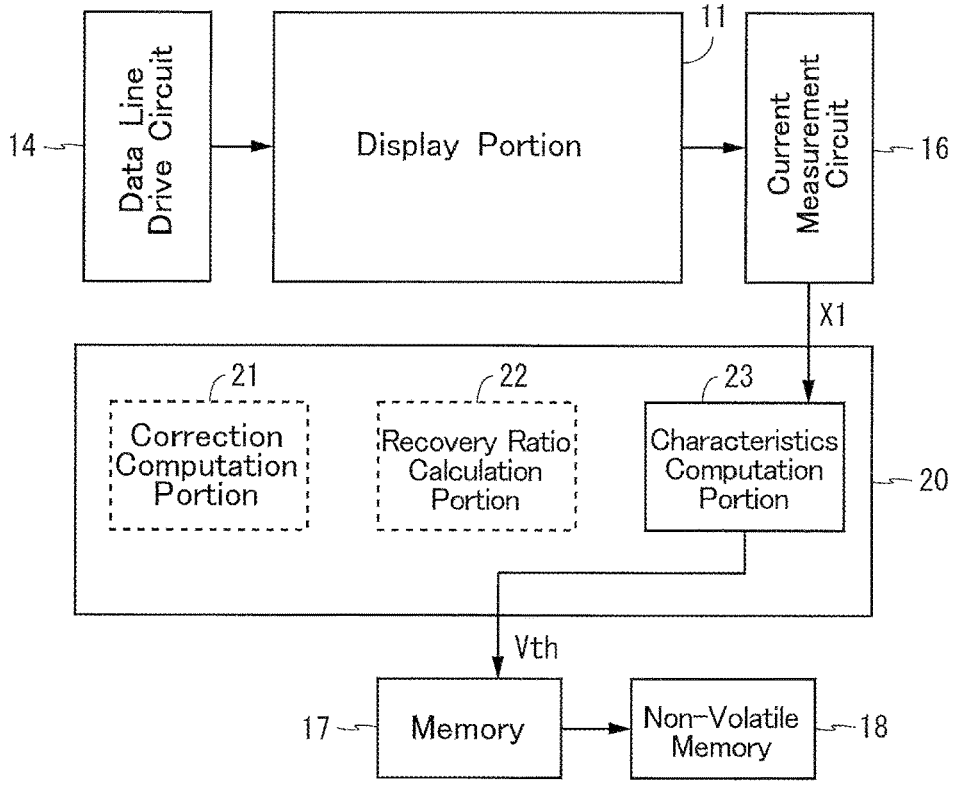
FIG. 6 is a diagram illustrating the operation of the correction circuit shown in FIG. 4 at the time of power off.
Figure 7:
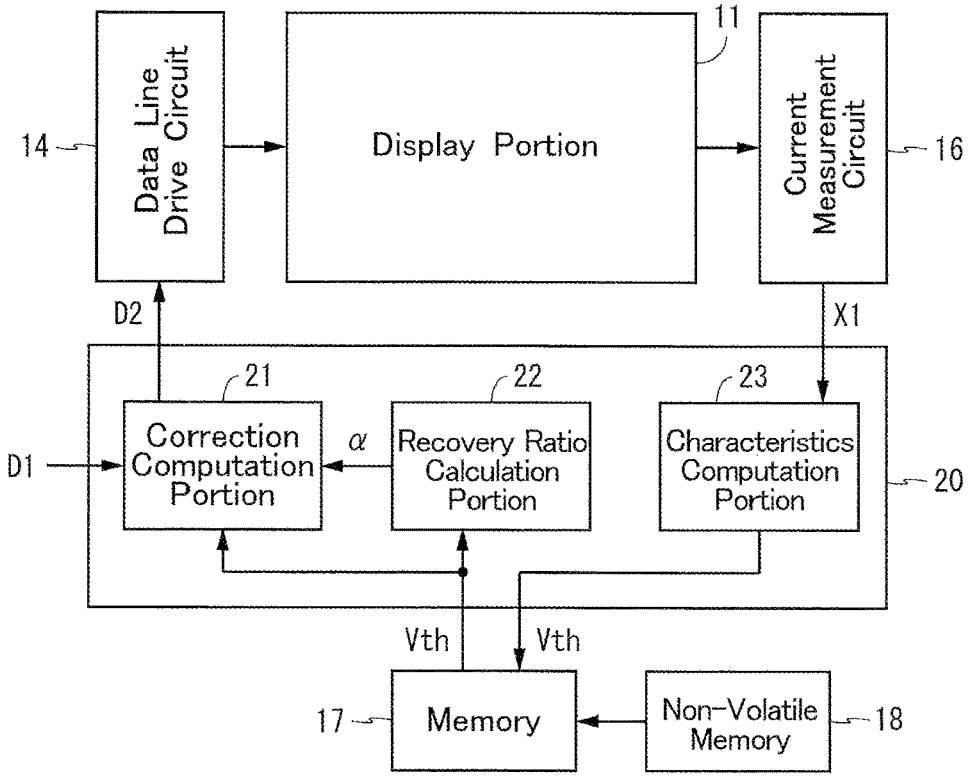

FIG. 4 is a block diagram illustrating the details of the correction circuit 20. As shown in FIG. 4, the correction circuit 20 includes a correction computation portion 21, a recovery ratio calculation portion 22, and a characteristics computation portion 23. FIGS. 5, 6, and 7 are diagrams illustrating the operation of the correction circuit 20 during a normal mode, at the time of power off, and at the time of power on, respectively. Note that FIGS. 4 to 7 do not show some elements of the organic EL display device 10.

The operation of the organic EL display device 10 will be described below with reference to FIGS. 5 to 7. The threshold voltage of the drive transistor is assumed to be initially the same among all pixel circuits 30. The memory 17 has the drive transistor's threshold voltage Vth (present threshold voltage) stored for each pixel circuit 30.

During the normal mode (FIG. 5), the correction computation portion 21 reads out the threshold voltages Vth of the drive transistors from the memory 17. While referencing the threshold voltages Vth being read out from the memory 17, the correction computation portion 21 corrects video signals D1 outputted by the display control circuit 12 and thereby obtains corrected video signals D2. On the basis of the corrected video signals D2, the data line drive circuit 14 drives the data lines S1 to Sn during each horizontal period.

The data line drive circuit 14 applies a measurement voltage to the data lines S1 to Sn during the writing period within the current measurement period. One row of pixel circuits 30 output the currents that are flowing through the drive transistors, to the data lines S1 to Sn during the measurement period within the current measurement period. The current measurement circuit 16 measures these n currents outputted to the data lines S1 to Sn, and outputs measurement result signals X1 indicating the results of the current measurements. On the basis of the measurement result signals X1 outputted by the current measurement circuit 16, the characteristics computation portion 23 obtains threshold voltage Vth of the drive transistor for each pixel circuit 30. The threshold voltages Vth obtained by the characteristics computation portion 23 are stored to the memory 17.

It should be noted that the current measurement circuit 16 may measure currents for a plurality of rows of pixel circuits 30 during the current measurement period or may measure currents for all rows of pixel circuits 30 at a necessary time.

At the time of power off (FIG. 6), specific pixel circuits are measured for the amount of current flowing through the drive transistor in a manner similar to that used during the current measurement period. In the case where the specific pixel circuits are arranged in p rows (where p is an integer of 1 or more), the process of measuring one row of pixel circuits 30 for the amount of current flowing through the drive transistor is performed p times. In each round of the process, the current measurement circuit 16 measures n currents outputted to the data lines S1 to Sn, and outputs measurement result signals X1 indicating the results of the current measurements. On the basis of the measurement result signals X1 outputted by the current measurement circuit 16, the characteristics computation portion 23 obtains threshold voltages Vth of the drive transistors in the specific pixel circuits. The obtained threshold voltages Vth are stored to the memory 17. After being stored to the memory 17, the threshold voltages of the drive transistors in the specific pixel circuits are updated to the latest values at the time of power off. Thereafter, all of the threshold voltages Vth stored in the memory 17 are copied and transferred to the non-volatile memory 18.

At the time of power on (FIG. 7), all threshold voltages Vth stored in the non-volatile memory 18 are copied and transferred to the memory 17. Moreover, the specific pixel circuits are measured for the amount of current flowing through the drive transistor earlier than the general pixel circuits in a manner similar to that used during the current measurement period. The memory 17 has the following stored therein when the current measurements are completed for all of the specific pixel circuits: threshold voltages obtained for the drive transistors in the general pixel circuits during the normal mode before power off; threshold voltages obtained for the drive transistors in the specific pixel circuits at the time of power off; and threshold voltages obtained for the drive transistors in the specific pixel circuits at the time of power on. On the basis of these threshold voltages, the recovery ratio calculation portion 22 obtains a recovery ratio $\alpha$ for each pixel circuit 30 in a manner to be described later. The correction computation portion 21 corrects video signals D1 for the specific pixel circuits and the general pixel circuits using a math formula that depends on the recovery ratio $\alpha$, after power on until the current measurements are completed for all of the general pixel circuits. Thereafter, the correction computation portion 21 corrects the video signals D1 for the specific pixel circuits and the general pixel circuits using a math formula that does not depend on the recovery ratio $\alpha$ (normal mode operation).

The organic EL display device 10 stops display, for example, when an instruction to turn off the display is received or when the user has not operated the device for a predetermined time period. In such cases, the organic EL display device 10 operates in the same manner as at the time of power off. The organic EL display device 10 restarts the display, for example, when an instruction to turn on the display is received. In this case, the organic EL display device 10 operates in the same manner as at the time of power on. However, when the power is not turned off, there is no need to copy and transfer threshold voltages between the memory 17 and the non-volatile memory 18.

Figure 8:
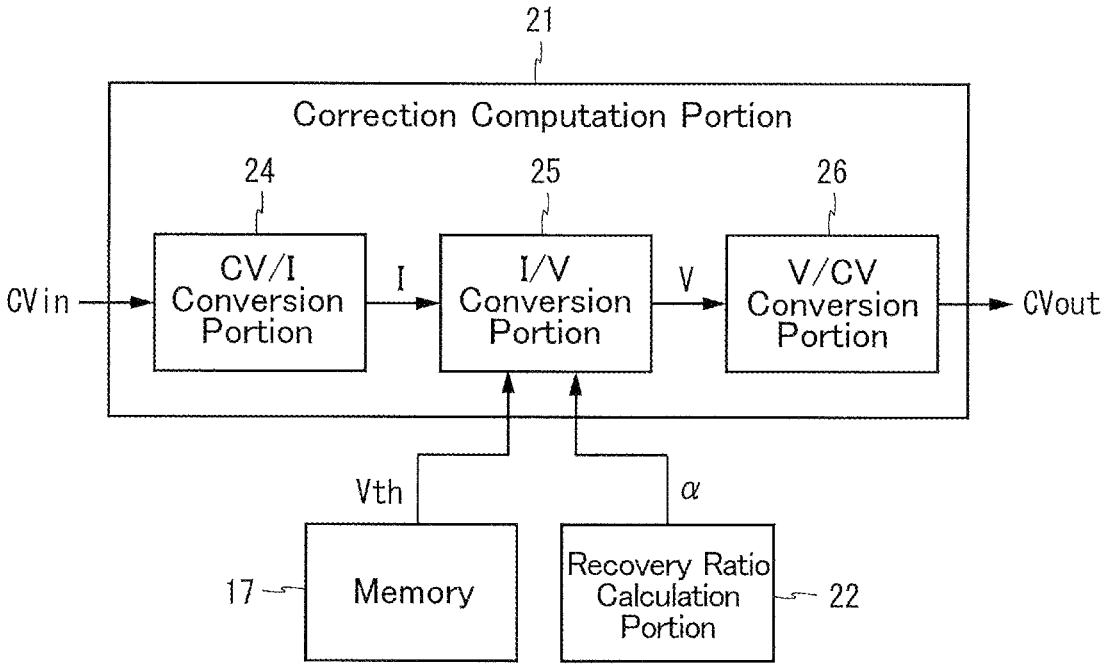
FIG. 8 is a block diagram illustrating the details of a correction computation portion in the correction circuit shown in FIG. 4.

FIG. 8 is a block diagram illustrating the details of the correction computation portion 21. As shown in FIG. 8, the correction computation portion 21 includes a CV/I conversion portion 24, an I/V conversion portion 25, and a V/CV conversion portion 26. Described below is a case where the correction computation portion 21 obtains a code value CVout included in a video signal D2 on the basis of a code value CVin included in a video signal D1. The code values CVin and CVout are, for example, 8-bit data.

The CV/I conversion portion 24 converts an inputted code value CVin into a current value I. In the case of a typical organic EL display device, the current value is proportional to approximately the square of the code value. The CV/I conversion portion 24 includes, for example, a table containing the correspondence between code values and current values. By using a table, the CV/I conversion portion 24 can be readily implemented.

The I/V conversion portion 25 converts the current value I obtained by the CV/I conversion portion 24 into a voltage value V. In addition to the current value I, the I/V conversion portion 25 receives a drive transistor threshold voltage Vth read out from the memory 17 and a recovery ratio $\alpha$ obtained by the recovery ratio calculation portion 22. In the case of a typical organic EL display device, the current value is proportional to the voltage value raised to approximately the one-half power. The I/V conversion portion 25 includes, for example, a table containing the correspondence between current values and voltage values.

During the normal mode, the I/V conversion portion 25 performs an arithmetic operation as shown in equation (1) below, thereby obtaining a corrected voltage value V. When display is restarted, the I/V conversion portion 25 keeps performing an arithmetic operation as shown in equation (2) below and thereby obtaining a corrected voltage value V until current measurements are completed for all general pixel circuits.

$$V=V0+(Vth3-Vth1) \quad (1)$$

$$V=V0+(1-\alpha)\times(Vth2-Vth1) \quad (2)$$

Note that in equations (1) and (2), V0 represents a voltage value corresponding to a current value 1, Vth1 represents an initial drive transistor threshold voltage, Vth2 represents a drive transistor threshold voltage obtained for a general pixel circuit during the normal mode operation before power off (a drive transistor threshold voltage obtained for a specific pixel circuit at the time of power off), and Vth3 represents a present drive transistor threshold voltage.

The V/CV conversion portion 26 converts the voltage value V obtained by the I/V conversion portion 25 into a code value CVout. In the case of a typical organic EL display device, the code value is proportional to the voltage value. The V/CV conversion portion 26 includes, for example, a table containing the correspondence between voltage values and code values, or includes a multiplier. By using a table or a multiplier, the V/CV conversion portion 26 can be readily implemented.

In this manner, during the normal mode, the correction computation portion 21 obtains the code value CVout on the basis of the code value CVin using equation (1) not depending on the recovery ratio α. Accordingly, during the normal mode, it is possible to suitably correct video signals considering deterioration of the characteristic of the drive transistor and display a suitably compensated image. Moreover, when display is restarted, the correction computation portion 21 keeps obtaining the code value CVout on the basis of the code value CVin using equation (2) depending on the recovery ratio α until current measurements are completed for all general pixel circuits. Accordingly, when display is restarted, it is possible to suitably correct video signals considering deterioration and recovery of the characteristic of the drive transistor and display a suitably compensated image.

Figure 9:
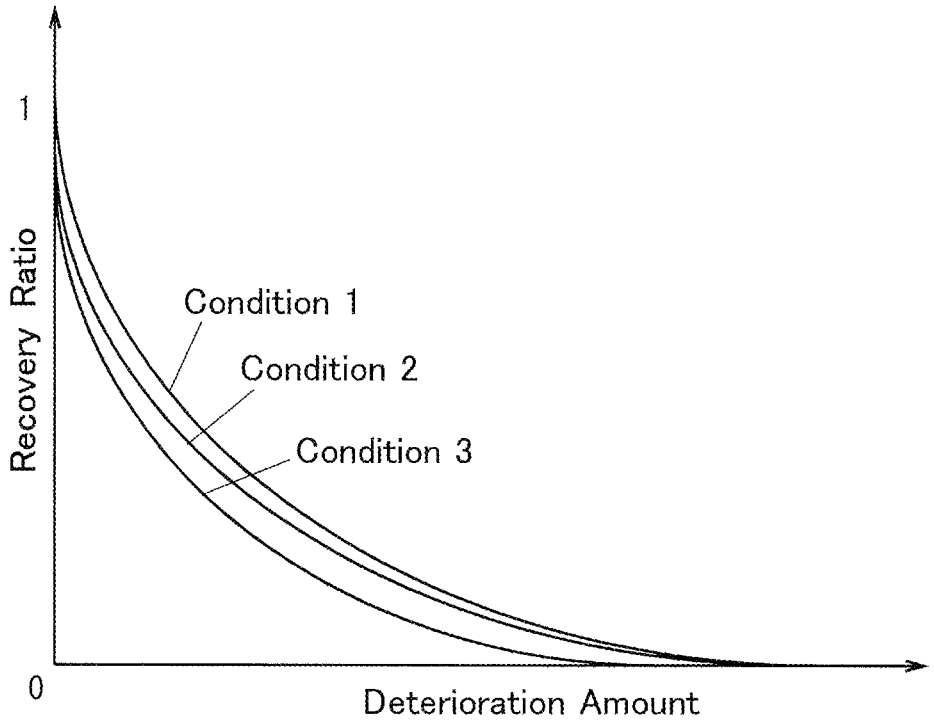
FIG. 9 is a graph showing the relationship between a deterioration amount and a recovery ratio for the drive transistor in the organic EL display device shown in FIG. 1.

The recovery ratio calculation portion 22 will be described in detail below. FIG. 9 is a graph showing the relationship between the deterioration amount and the recovery ratio. As shown in FIG. 9, the recovery ratio decreases as the deterioration amount increases. Moreover, the relationship between the deterioration amount and the recovery ratio changes depending on various conditions (e.g., duration of power-off state, operating temperature, etc.). The recovery ratio is not uniquely determined by the deterioration amount and varies among pixel circuits 30 in the same display portion 11.

The recovery ratio calculation portion 22 according to the present embodiment determines the relationship between the deterioration amount and the recovery ratio on the basis of deterioration amounts and recovery ratios obtained individually for a plurality of specific pixel circuits (referred to below as individual deterioration amounts and individual recovery ratios), and the recovery ratio calculation portion 22 also obtains a recovery ratio α for each pixel circuit on the basis of the determined relationship and a deterioration amount that corresponds to a current value measured before display is stopped. Here, for the sake of simplification, three pixel circuits Pa, Pb, and Pc are assumed to be specific pixel circuits. Pixel circuits Pa, Pb, and Pc may be arranged in the same row or in different rows.

Figure 10:
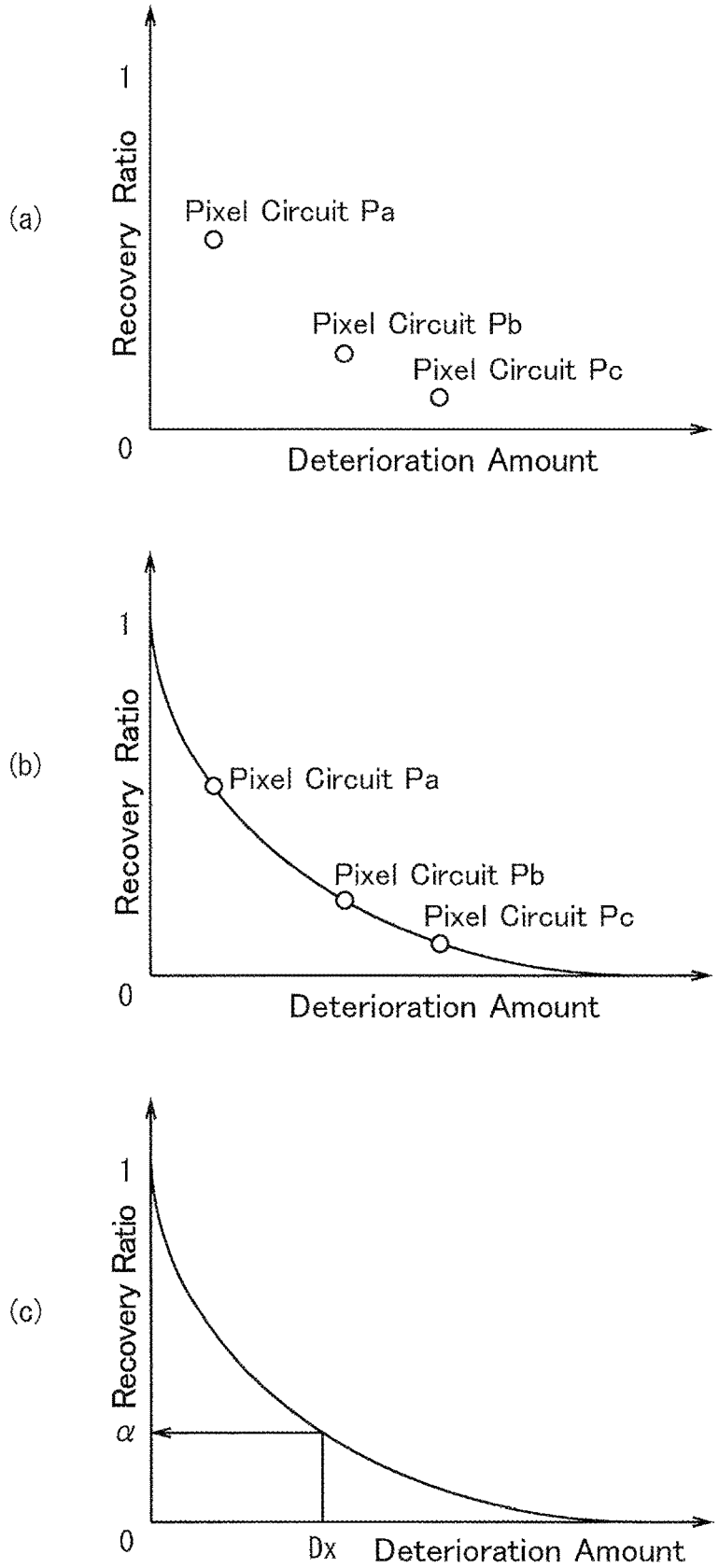
FIG. 10 provides graphs describing the operation of a recovery ratio calculation portion in the organic EL display device according to the first embodiment.

FIG. 10 provides graphs describing the operation of the recovery ratio calculation portion 22 according to the present embodiment. The recovery ratio calculation portion 22 initially obtains individual deterioration amounts and individual recovery ratios for pixel circuits Pa, Pb, and Pc (FIG. 10(*a*)). Next, the recovery ratio calculation portion 22 performs interpolation and extrapolation on the basis of the individual deterioration amounts and the individual recovery ratios for pixel circuits Pa, Pb, and Pc, thereby estimating a recovery ratio curve representing the relationship between the deterioration amount and the recovery ratio (FIG. 10(*b*)). Next, the recovery ratio calculation portion 22 references the recovery ratio curve and obtains a recovery ratio α for a pixel circuit on the basis of a deterioration amount Dx for that pixel circuit (FIG. 10(*c*)).

As described above, the display device according to the present embodiment (organic EL display device 10) includes: the display portion 11 including the pixel circuits 30, each including a drive transistor (TFT 31) and a display element (organic EL element 34) connected in series; the drive circuit (consisting of the scanning line drive circuit 13, the data line drive circuit 14, and the control line drive circuit 15) configured to drive the display portion 11; the current measurement circuit 16 configured to measure a current flowing through the drive transistor, from outside the display portion 11; and the correction circuit 20 configured to obtain a characteristic (threshold voltage) of the drive transistor on the basis of an amount of the current and correct a video signal D1 for use in driving the display portion 11, on the basis of the obtained characteristic. The pixel circuits 30 are classified into specific and general pixel circuits; when display is restarted, the current measurement circuit 16, along with the drive circuit, measures the current for the specific pixel circuit as a first current, and the correction circuit 20, which includes the recovery ratio calculation portion 22 configured to obtain a recovery ratio α for the characteristic on the basis of an amount of the first current and correct the video signal D1 for each of the specific and general pixel circuits using the recovery ratio α.

In the case of the above display device, when display is restarted, the recovery ratio α for the characteristic of the drive transistor in the specific pixel circuit is obtained on the basis of the amount of current flowing through the drive transistor, and the video signal D1 is corrected using the recovery ratio α until the normal mode operation becomes possible. Accordingly, the above display device renders it possible to, when display is restarted, display a suitably compensated image considering that the characteristic of the drive transistor recovers while display is stopped. Moreover, when display is restarted, the current flowing through the drive transistor in the specific pixel circuit is measured so that a process for restarting the display can be performed in a short period of time.

Furthermore, when display is stopped, the current measurement circuit 16, along with the drive circuit, measures the current for the specific pixel circuit as a second current, and the recovery ratio calculation portion obtains the recovery ratio α on the basis of a characteristic corresponding to the amount of the first current and a characteristic corresponding to the amount of the second current. Accordingly, when display is stopped, the latest characteristic can be obtained for the drive transistor in the specific pixel circuit.

Thus, it is possible to obtain a suitable recovery ratio and display a suitably compensated image when display is restarted.

Furthermore, the display portion 11 includes a plurality of (three) specific pixel circuits, and the recovery ratio calculation portion 22 obtains individual deterioration amounts and individual recovery ratios for characteristic for the specific pixel circuits, determines a relationship between the deterioration amount and the recovery ratio (the relationship being as represented by the curve in FIG. 10), on the basis of the individual deterioration amounts and individual recovery ratios, and obtains the recovery ratio α on the basis of the determined relationship and the deterioration amount that corresponds to an amount of the current measured before display is stopped. Thus, it is possible to derive a suitable recovery ratio α from using the specific pixel circuits and display a suitably compensated image when display is restarted.

Furthermore, the specific pixel circuits are pixel circuits 30 included in a plurality of rows in the display portion 11. Accordingly, even when the display portion 11 has variations in characteristics, it is possible to obtain a suitable recovery ratio α. Moreover, the characteristic of the drive transistor is the threshold voltage of the drive transistor. Accordingly, when display is restarted, it is possible to display a suitably compensated image considering that the threshold voltage of the drive transistor recovers while display is stopped.

Second Embodiment

An organic EL display device according to a second embodiment has the same configuration as the organic EL display device according to the first embodiment and operates similarly to the organic EL display device according to the first embodiment (see FIGS. 1 and 5 to 7). In the organic EL display device according to the present embodiment, the recovery ratio calculation portion 22 obtains the recovery ratio α differently from that in the first embodiment.

Figure 11:
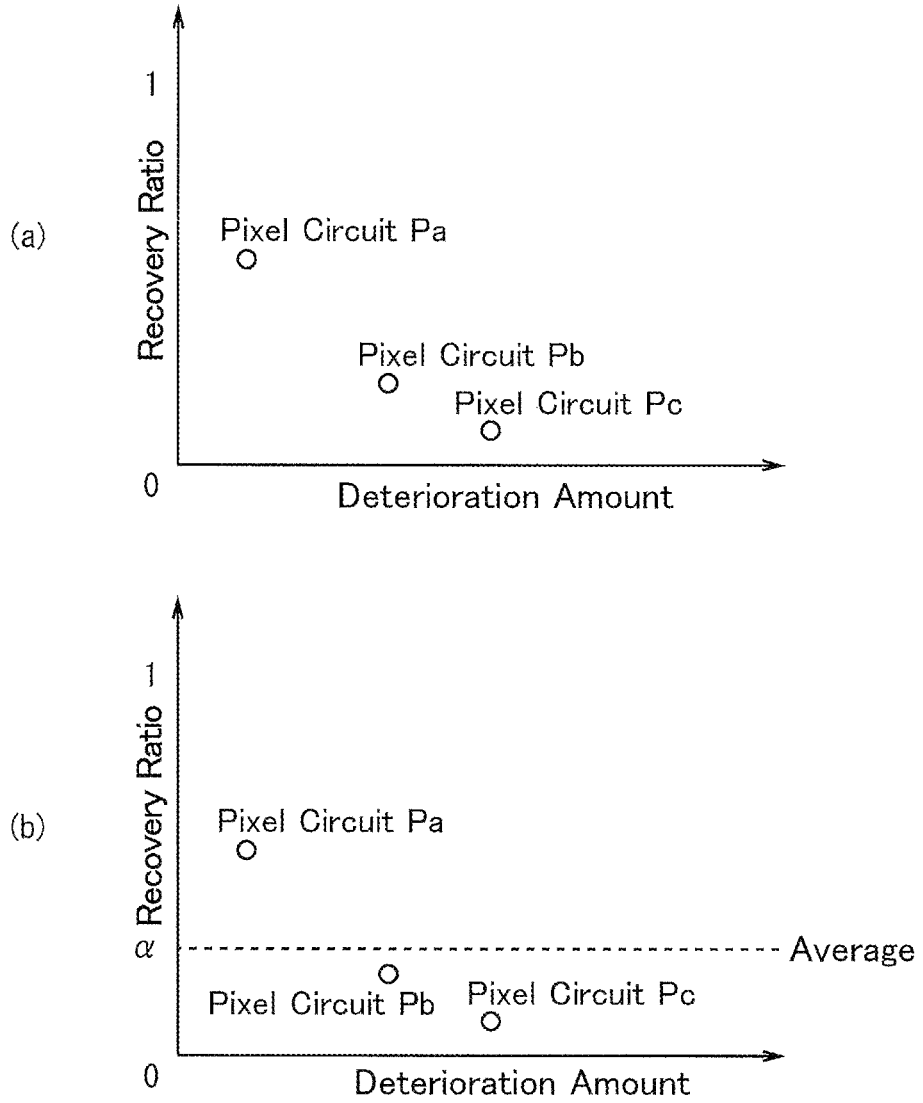
FIG. 11 provides graphs describing the operation of a recovery ratio calculation portion in an organic EL display device according to a second embodiment.

FIG. 11 provides graphs describing the operation of the recovery ratio calculation portion 22 according to the present embodiment. The recovery ratio calculation portion 22 according to the present embodiment initially obtains individual deterioration amounts and individual recovery ratios for pixel circuits Pa, Pb, and Pc (FIG. 11(*a*)). Next, the recovery ratio calculation portion 22 determines an average of the obtained individual recovery ratios and sets the determined average as the recovery ratio α for all pixel circuits 30.

In the organic EL display device according to the present embodiment, the display portion 11 includes a plurality of (three) specific pixel circuits, and for these specific pixel circuits, the recovery ratio calculation portion 22 obtains individual recovery ratios for the characteristic of the drive transistor, and also determines an average of the obtained individual recovery ratios as the recovery ratio α. Accordingly, the recovery ratio for the characteristic of the drive transistor can be readily obtained.

It should be noted that in the case of the organic EL display device according to the present embodiment, when the number of specific pixel circuits is small, the recovery ratio α tends to have a wide margin of error. Therefore, in the case of the organic EL display device according to the present embodiment, it is preferred that the number of specific pixel circuits be large to a certain extent.

Third Embodiment

An organic EL display device according to a third embodiment has the same configuration as the organic EL display devices according to the first and second embodiments and operates similarly to the organic EL display devices according to the first and second embodiments (see FIGS. 1 and 5 to 7). In the organic EL display device according to the present embodiment, the recovery ratio calculation portion 22 obtains the recovery ratio α differently from those in the first and second embodiments. It is assumed below that there are nine specific pixel circuits consisting of three red pixel circuits, three green pixel circuits, and three blue pixel circuits.

Figure 12:
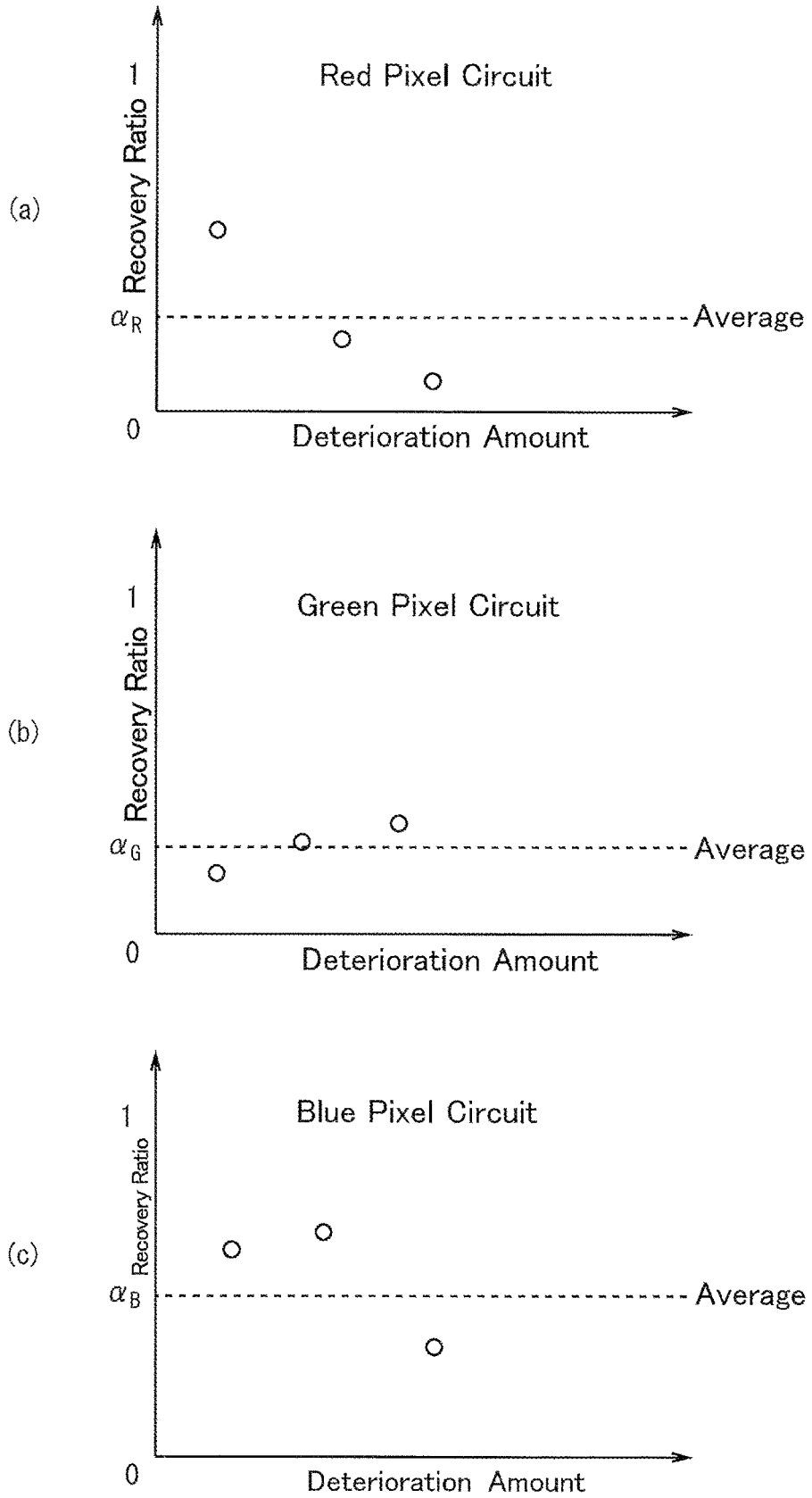
FIG. 12 provides graphs describing the operation of a recovery ratio calculation portion in an organic EL display device according to a third embodiment.

FIG. 12 provides graphs describing the operation of the recovery ratio calculation portion 22 according to the present embodiment. The recovery ratio calculation portion 22 according to the present embodiment initially obtains individual deterioration amounts and individual recovery ratios for nine specific pixel circuits. Next, the recovery ratio calculation portion 22 classifies the nine specific pixel circuits into groups of three according to display colors. Next, the recovery ratio calculation portion 22 determines an average of the individual recovery ratios for each display color and sets the average as the recovery ratio for the pixel circuits 30 for that color.

Specifically, the recovery ratio calculation portion 22 determines an average αR of the individual recovery ratios for three specific red pixel circuits, and sets the average αR as the recovery ratio for all red pixel circuits (FIG. 12(*a*)). Similarly, the recovery ratio calculation portion 22 sets an average αG of the individual recovery ratios for three specific green pixel circuits as the recovery ratio for all green pixel circuits (FIG. 12(*b*)) and also sets an average αB of the individual recovery ratios for three specific blue pixel circuits as the recovery ratio for all blue pixel circuits (FIG. 12(*c*)).

For example, in the case where red is displayed more frequently than green and blue, the drive transistors in the red pixel circuits deteriorate in characteristics earlier than those in the pixel circuits for the other colors. Even in such a case, the organic EL display device according to the present embodiment can obtain the recovery ratio for the characteristic of the drive transistor for each display color, and display a suitably compensated image when display is restarted.

In the organic EL display device according to the present embodiment, the display portion 11 includes plurality of (nine) specific pixel circuits, and the recovery ratio calculation portion 22 obtains individual recovery ratios for the characteristic for the specific pixel circuits, and also determines averages αR, αG, and αB of the individual recovery ratios for the respective display colors as recovery ratios α. Thus, the recovery ratio for the characteristic of the drive transistor can be readily obtained for each display color.

For the organic EL display devices according to the first through third embodiments described above, numerous variants can be configured. For example, the specific pixel circuits may be pixel circuits included in a plurality of rows in the display portion 11. In such a case, it is possible to derive a suitable recovery ratio α from using the specific pixel circuits and display a suitably compensated image when display is restarted. Alternatively, the specific pixel circuits may be pixel circuits included in one row in the display portion 11, or only one pixel circuit in the display portion 11 may be used as a specific pixel circuit. In such cases, the recovery ratio can be readily obtained by measuring the current flowing through the drive transistor in a single operation. Moreover, when the recovery ratio α is less than a predetermined value (e.g., 0.1), the correction circuit 20 may correct the video signal D1 without using the recovery ratio α. As a result, when the characteristic of the drive transistor does not recover well, the video signal D1 can be corrected without considering the recovery.

Furthermore, the pixel circuit 30 may be configured in any manner, so long as the pixel circuit 30 has the function of outputting the current flowing through the drive transistor. Moreover, the display portion 11 may include monitoring lines in addition to the data lines such that the pixel circuits 30 output the currents that are flowing through the drive transistors, to the monitoring lines. Further, the correction circuit 20 may obtain a characteristic of the drive transistor other than or in addition to the threshold voltage. In addition, the correction circuit 20 does not have to include the characteristics computation portion 23 and may write the measurement result signal X1 outputted by the current measurement circuit 16, to the memory 17 without modification. In such a case, the correction computation portion 21 and the recovery ratio calculation portion 22 have the function of the characteristics computation portion 23.

The drive transistor deteriorates and recovers from the deterioration not only in the case of organic EL display devices but also in the case of other display devices including current-driven display elements, such as inorganic EL display devices including inorganic light-emitting diodes as display elements and QLED (quantum-dot light-emitting diode) display devices including quantum-dot light-emitting diodes as display elements. Accordingly, methods similar to those in the first through third embodiments may be applied to various display devices including current-driven display elements.

DESCRIPTION OF THE REFERENCE CHARACTERS

10 organic EL display device
11 display portion
12 display control circuit
13 scanning line drive circuit
14 data line drive circuit
15 control line drive circuit
16 current measurement circuit
17 memory
18 non-volatile memory
20 correction circuit
21 correction computation portion
22 recovery ratio calculation portion
23 characteristics computation portion
24 CV/I conversion portion
25 I/V conversion portion
26 V/CV conversion portion
30 pixel circuit
31 TFT (drive transistor)
32, 33 TFT
34 organic EL element (display element)

The invention claimed is:

1. A display device comprising:

a display portion including a plurality of pixel circuits, each including a drive transistor and a display element connected in series;

a drive circuit configured to drive the display portion;

a current measurement circuit configured to measure a current flowing through the drive transistor, from outside the display portion; and a correction circuit configured to obtain a characteristic of the drive transistor on the basis of an amount of the current and correct a video signal for use in driving the display portion, on the basis of the characteristic, wherein, the pixel circuits are classified into specific and general pixel circuits, when display is restarted, the current measurement circuit, along with the drive circuit, measures the current for the specific pixel circuit as a first current, and the correction circuit includes a recovery ratio calculation portion configured to obtain a recovery ratio for the characteristic on the basis of an amount of the first current, and corrects the video signal for each of the specific and general pixel circuits using the recovery ratio.

2. The display device according to claim 1, wherein, when display is stopped, the current measurement circuit, along with the drive circuit, measures the current for the specific pixel circuit as a second current, and the recovery ratio calculation portion obtains the recovery ratio on the basis of a characteristic corresponding to an amount of the first current and a characteristic corresponding to an amount of the second current.

3. The display device according to claim 2, wherein, the display portion includes a plurality of the specific pixel circuits, each identical to the specific pixel circuit; and the recovery ratio calculation portion obtains individual deterioration amounts and individual recovery ratios for the characteristic for the specific pixel circuits, obtains a relationship between the deterioration amount and the recovery ratio for the characteristic, on the basis of the individual deterioration amounts and the individual recovery ratios, and obtains the recovery ratio on the basis of the relationship and the deterioration amount that corresponds to an amount of the current measured before display is stopped.

4. The display device according to claim 2, wherein, the display portion includes a plurality of the specific pixel circuits; and the recovery ratio calculation portion obtains individual recovery ratios for the characteristic for the specific pixel circuits, and obtains an average of the individual recovery ratios as the recovery ratio.

5. The display device according to claim 2, wherein, the display portion includes a plurality of the specific pixel circuits; and the recovery ratio calculation portion obtains individual recovery ratios for the characteristic for the specific pixel circuits, and obtains an average of the individual recovery ratios for each display color as the recovery ratio.

6. The display device according to claim 1, wherein the specific pixel circuit is provided in plurality and included in a plurality of rows in the display portion.

7. The display device according to claim 1, wherein the specific pixel circuit is provided in plurality and included in one row in the display portion.

8. The display device according to claim 1, wherein the specific pixel circuit is a pixel circuit included in the display portion.

9. The display device according to claim 1, wherein, when the recovery ratio is less than a predetermined value, the correction circuit corrects the video signal without using the recovery ratio.

10. The display device according to claim 9, wherein the predetermined value is 0.1.

11. The display device according to claim 1, wherein the characteristic is a threshold voltage of the drive transistor.

12. A method for driving a display device having a display portion including a plurality of pixel circuits, each including a drive transistor and a display element connected in series, the method comprising:

a driving step of driving the display portion;

a measuring step of measuring a current flowing through the drive transistor, from outside the display portion; and a correcting step of obtaining a characteristic of the drive transistor on the basis of an amount of the current and correcting a video signal for use in driving the display portion, on the basis of the characteristic, wherein, the pixel circuits are classified into specific and general pixel circuits, when display is restarted, the measuring step is performed along with the driving step to measure the current for the specific pixel circuit as a first current, and the correcting step includes a recovery ratio calculating step of obtaining a recovery ratio for the characteristic on the basis of an amount of the first current, and in the correcting step the video signal is corrected for each of the specific and general pixel circuits using the recovery ratio.

13. The method according to claim 12, wherein, when display is stopped, the measuring step is performed along with the driving step to measure the current for the specific pixel circuit as a second current, and in the recovery ratio calculating step, the recovery ratio is obtained on the basis of a characteristic corresponding to an amount of the first current and a characteristic corresponding to an amount of the second current.

* * * * *